United States Patent [19]

Schott

[11] 3,937,999

[45] Feb. 10, 1976

[54] REDUCTION OF BLANKING REQUIREMENTS IN A GASEOUS GLOW DISCHARGE DISPLAY TUBE HAVING A PLURALITY OF DIGITS

[75] Inventor: Dan J. Schott, Scottsdale, Ariz.

[73] Assignee: Beckman Instruments, Inc., Fullerton, Calif.

[22] Filed: Oct. 17, 1973

[21] Appl. No.: 407,130

[52] U.S. Cl. ..... 315/169 TV; 313/188; 313/226; 340/336

[51] Int. Cl.[2] ..... H05B 37/00

[58] Field of Search ..... 313/188, 226; 315/169 TV; 340/336

[56] References Cited

UNITED STATES PATENTS

| | | | |
|---|---|---|---|
| 3,634,850 | 1/1972 | Miyasaka | 313/226 X |
| 3,675,065 | 7/1972 | Warne | 313/109.5 |
| 3,675,066 | 7/1972 | Armstrong | 313/109.5 |
| 3,790,850 | 2/1974 | Doane | 315/169 TV |

*Primary Examiner*—R. V. Rolinec
*Assistant Examiner*—Lawrence J. Dahl
*Attorney, Agent, or Firm*—R. J. Steinmeyer; J. J. McCormack

[57] ABSTRACT

A gaseous glow discharge display tube having a plurality of digits positioned within a common envelope is filled with a gas mixture of such a composition so as to reduce the blanking requirements for streamer elimination. Within a prescribed range of current densities, and applied voltage, blanking requirements may be entirely elininated.

12 Claims, 3 Drawing Figures

REDUCTION OF BLANKING REQUIREMENTS IN A GASEOUS GLOW DISCHARGE DISPLAY TUBE HAVING A PLURALITY OF DIGITS

BACKGROUND OF THE INVENTION

1. Field of the Invention

The present invention relates to cold cathode gaseous glow discharge display devices of the multi-digit or character indicator type and more particularly to features related to multiplexed operation of such indicators for reducing blanking requirements for streamer elimination.

2. Description of the Prior Art

Each digit or character position of cold cathode gaseous glow discharge multi-digit indicators to which the present invention relates typically comprises a plurality of cathodes arranged in a pattern such as a figure eight representative of each digit and a respective operatively associated anode. The plurality of digits of such tubes are generally contained in a common envelope with an ionizable gas such as neon. Such tubes generally are of the type disclosed in U.S. Pat. No. 3,675,065 issued July 4, 1972, "Planar Gas Discharge Indicator", by L. C. Warne and U.S. Pat. No. 3,675,066 issued July 4, 1972, "Planar Raised Cathode Alpha-Numeric Gas Discharge Indicator", by J. B. Armstrong et. al., both patents assigned to the assignee of the present invention. For multiplexed operation these tubes would be constructed with individual anodes associated respectively with each digit position.

In the case of multiplexed operation of such indicators; the corresponding cathodes of each digit are connected to each other and the cathode groups (comprising the figure-eight, for example) are selectively energized from a common decoder-driver while the anodes associated with adjacent digits are sequentially energized. A symbol is displayed at each digit position in accordance with the selective energization of the cathodes (which determine the symbol) at the instant of energization of each anode (which determines the digit position). The rate of sequential energization of the anodes is sufficiently rapid to preclude observable flicker of the display.

In order to achieve suitable operation without undesirable effects, it is necessary in prior art indicators to utilize a blanking interval between energizations of successive anodes, that is energization must be removed from a previously energized anode before excitation is applied to the next adjacent anode with a blanking interval in between. Alternatively the blanking interval may be applied with respect to the cathode excitation or with respect to both the anode and cathode excitations. In the absence of a blanking interval, a positive column "streamer" glow is likely to occur between cathodes of the previously energized digit position and the adjacent successively energized anode because the ionized gas in the space therebetween has not had sufficient time to deionize. Such streamers are undesirable as they tend to mar the clarity of the display presentation, and produce "glow" in undesired locations. Provision of a sufficiently long blanking interval between energizations of digit positions eliminates such streamers by permitting the gas between successively ionized digits to de-ionize before transferring the energization therebetween. If, however, the blanking interval is insufficient, streamers are still likely to occur. The use of a suitable blanking interval therefore eliminates the occurrence of streamers, but on the other hand has the undesirable effect of limiting the sequential excitation rate of the digits with the likelihood of attendant flicker or alternatively limiting the number of digit positions which can be multiplexed.

An alternative to blanking for streamer elimination is to provide interdigit partitions or other mechanical isolation means so that positive column streamers are prevented from occuring between electrodes of adjacent digits. This solution increases the manufacturing complexity and hence the cost of such indicators.

SUMMARY OF THE INVENTION

It is a principal object of the present invention to provide means for overcoming the aforementioned limitations so as to significantly reduce or entirely eliminate the blanking interval without the occurrence of interdigit streamers and without resorting to interdigit partitioning or mechanical isolation.

The invention provides for the substantial reduction or complete elimination of the blanking interval required in prior art multidigit multiplexed indicators for the elimination of interdigit streamers. This result is achieved by the use of a particular composition gas mixture as the ionizable gas in the indicator tubes. Complete elimination of the necessity for a blanking interval may require utilizing means for controlling the current and/or voltage applied to the selectively energized cathodes so as to limit the current density to a predetermined value.

Gas mixtures (such as Penning mixtures) have been utilized in gaseous discharge indicator tubes for providing desirable properties such as lowering the minimum required voltage to ionize the display, reducing the electrical characteristics of the tube's dependence on manufacturing tolerances, etc. It was found quite unexpectedly that the combination of a multiplexed multidigit indicator tube with a particularly constituted gas mixture as the ionizable gas therein had the beneficial effect of substantially reducing the blanking interval compared to that required in such tubes with previously utilized gaseous atmospheres. It was a further surprising result that by suitably limiting the current density and applied voltages that the requirement for blanking could be entirely eliminated without the occurrence of interdigit streamers.

DESCRIPTION OF THE PREFERRED EMBODIMENT

Figure 1:
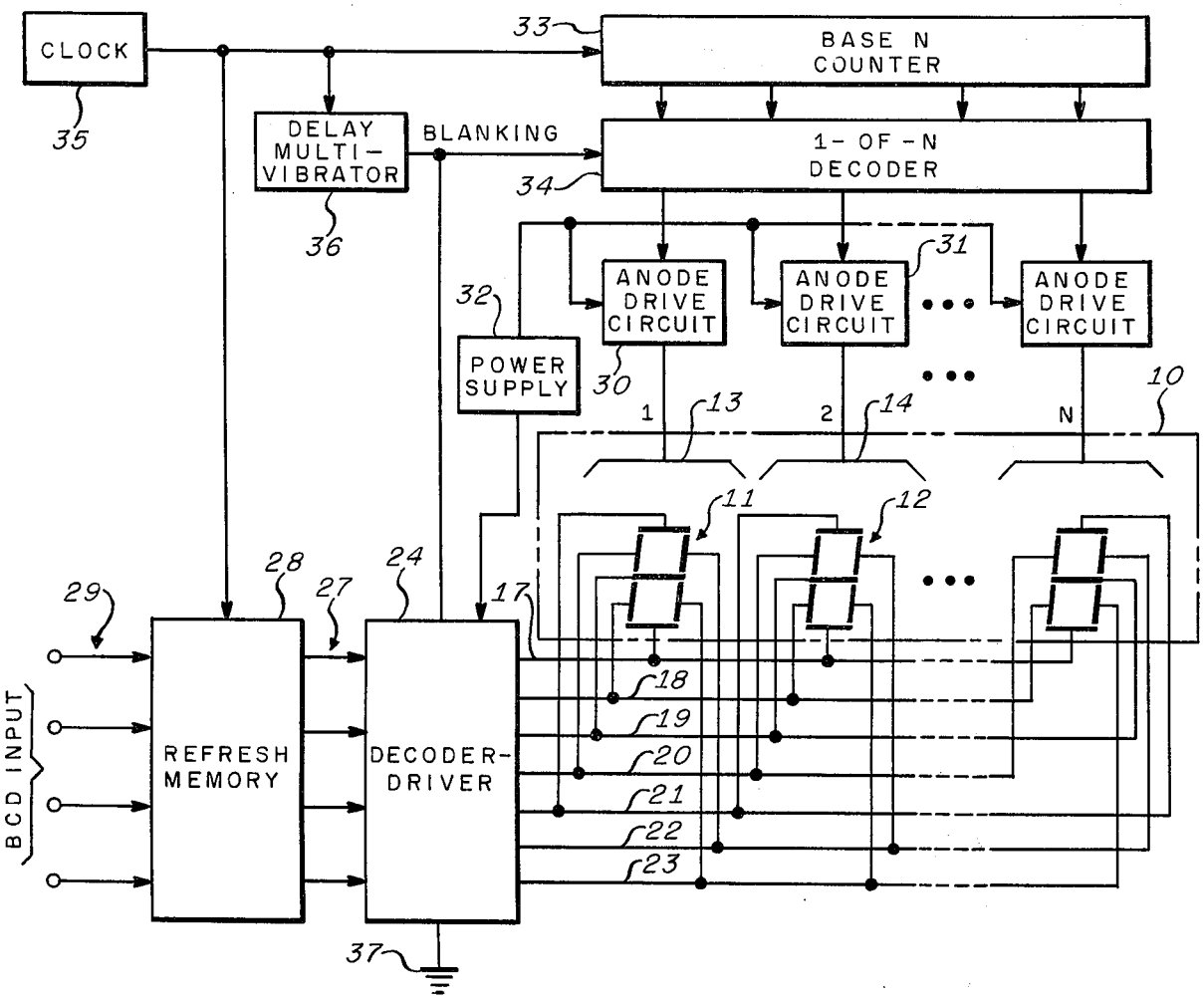
FIG. 1 is a block schematic diagram illustrating the multiplexed operation of a multidigit gaseous discharge display indicator.

Referring to FIG. 1, a cold cathode gaseous glow discharge multi-digit display 10 is illustrated. The display 10 would normally comprise a plurality of individual tubes each with a plurality of digit positions therein. For simplicity of description and illustration, however, the display 10 will be considered as comprising a single N digit position tube with a common envelope enclosing the electrodes therein. The tube 10 may generally be of the type described in the afore-cited patents except that each digit position would be provided with an individual operatively associated anode.

The tube 10 differs from prior art tubes of similar design in that a gaseous atmosphere of a particular composition is utilized therein to produce quite surprising results to be later discussed. The gas to be utilized is a mixture comprising neon and argon, the argon constituting approximately from 0.1 to 0.8 percent and the neon constituting the remainder thereof. Preferably a mixture comprising 99.5 percent neon and 0.5 percent argon is utilized.

The tube 10 comprises a plurality of digit positions indicated as 1 through N where each digit position includes a plurality of cathodes arranged in a pattern such as a figure eight. The digit positions 1 and 2, for example, include the groups of cathodes 11 and 12 respectively. Each digit position includes an anode operatively associated with the plurality of cathodes. For example, the digit positions 1 and 2 include the anodes 13 and 14 respectively. It is appreciated that the anodes 13 and 14 are schematically illustrated for simplicity of drawing. These anodes may conveniently comprise, for example, transparent metallic films deposited on the inner surface of the envelope faceplate (not shown) directly over the associated groups of cathodes.

In a multiplexed arrangement of the tube 10, corresponding cathodes in each group of cathodes are commonly connected in parallel. For example, the lower horizontal cathode in each group is connected to a conductor 17. In a similar manner the remaining corresponding cathodes in each group are commonly connected by the conductors 18–23 respectively.

For purposes of illustration, the conductors 17–23 are connected as the respective outputs of a decoder driver 24 which receives as inputs binary coded decimal signals on leads 27. The decoder driver 24 is a conventional logic and driving circuit that energizes selected combinations of the output leads 17–23 in response to binary coded decimal signals applied to the leads 27 so as to selectively ignite cathode segments to display characters corresponding to the input codes applied to the leads 27.

The leads 27 are connected to the outputs of a refresh memory 28. The refresh memory 28 comprises a conventional storage device for storing a number of binary coded decimal words equal to the number of digit positions of the display 10. The refresh memory 28 receives inputs, for example, binary coded decimal signals, on leads 29 which are stored in the memory 28 for reasons to be explained.

In multiplexed arrangement of the tube 10 the anodes thereof, such as anodes 13 and 14, are individually and sequentially energized by anode drive circuits such as the circuits 30 and 31 connected to the anodes 13 and 14 respectively. All of the anode drive circuits are connected to a power supply 32 for providing energization to the tube 10 through the individually actuated anode drive circuits. The power supply 32 also provides an input to the decoder driver 24 for energizing the cathode segments of the display tube 10.

The multiplexing arrangement of FIG. 1 also includes a Base-N counter that provides digital count output signals to a 1-of-N decoder 34 in response to clock pulses from a clock pulse generator 35. The counter 33, decoder 34 and clock generator 35 are conventional components well known in the art for sequentially applying energization to the output leads of the decoder 34 in response to successive clock pulses from the generator 35. In a well known manner the counter 33 provides digital count output signals that successively increase from for example, 0 to a maximum count in response to N pulses from the generator 35 after which the counter 33 returns to its initial count to begin another cycle in response to the next occurring N clock pulses. In response to the count sequence from the counter 33, the 1-of-N decoder 34 provides energization sequentially on its output leads. Thus, it is appreciated that in response to continuous train of clock pulses from the generator 35 the decoder 34 cyclically provides successive energization of its output leads.

The N output leads from the decoder 34 are connected respectively to the N anode drive circuits thus providing successive energization to the digit positions of the tube 10 in a cyclic manner. The anode drive circuits conveniently comprise conventional transistor switches for performing the function, or may comprise a complex MOS LSI circuit designed to perform this function.

As well as providing an input to the counter 33, the clock pulse generator 35 also provides an input to the memory 28 and to a delay multivibrator 36 for blanking purposes. The delay multivibrator 36 provides a blanking signal to the decoder 34 and/or to the decoder driver 24 for reasons to be discussed.

In multiplexed operation of the apparatus of FIG. 1, N binary coded decimal input signals are serially applied to the leads 29, the N signals representative of the characters to be displayed by the N digit positions of the tube 10, respectively. These N signals are stored in the memory 28 and are successively and cyclically provided on the leads 27 in response to the clock pulses from the clock pulse generator 35 at a rate controlled by the pulse repetition rate of the clock pulses. For each successive pulse provided by the clock pulse generator 35 the refresh memory 28 provides the next successive binary coded decimal signal to the decoder driver 24 and the counter decoder 33, 34 steps the energization to the next successive anode drive circuit so as to energize the associated digit position of the tube 10. In this manner combinations of the lines 17–23 are energized by the decoder driver 24 thereby energizing the cathodes connected thereto so as to display a selected character at each digit position as its corresponding anode is energized from its associated anode drive circuit. For example, if it is desired to display the character 7 at digit position 1 and the character 3 at digit position 2 the first pulse in a group of N pulses from the generator 35 will cause the memory 28 to provide the first stored binary coded decimal signal to the lines 27 which signal in this instance will represent the numeral 7. In response to this code signal, the decoder-driver 24 energizes lines 21–23 thus applying energization to the cathode segments that form the numeral 7. At the same time the counter 33 is stepped to its first count causing the decoder 34 to activate the anode drive circuit 30 which energizes the anode 13 causing the energized cathodes 11 to glow in the form of the numeral 7. The next occurring clock pulse causes the memory 28 to provide the next stored binary coded decimal signal which in this example represents the numeral 3 and also increments the counter 33 to cause the decoder 34 to activate the anode drive circuit 31. Under these conditions the leads 17, 19 and 21–23 are energized thus causing the cathodes 12 to display the numeral 3. This procedure is applied successively to each of the digit positions up to N and repeated at a rate sufficiently rapid to preclude flicker of the display presentation.

Figure 2:
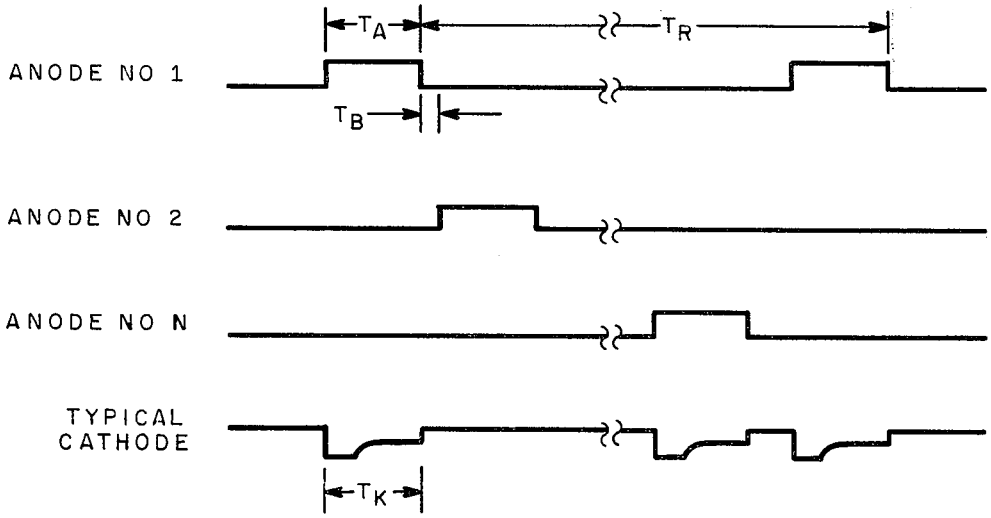
FIG. 2 is a waveform diagram illustrating waveforms useful in explaining the operation of the apparatus of FIG. 1.

Referring to FIG. 2, the voltage waveforms applied to the anodes and cathodes of the tube 10 by the anode drive circuits and the decoder-driver 24, respectively, are illustrated. The legend $T_a$ and $T_k$ indicate the intervals of energization of the anodes and cathodes respectively. The legend $T_r$ indicates the refresh interval for the display. It is noted that the cathode voltage energizing pulse is comprised of two levels, the lower level representing a firing potential and the upper level representing a sustained potential. These particular cathode voltages are controlled by conventional networks in the decoder driver 24.

Legend $T_b$ indicates a blanking interval or an interval between terminating the excitation at a digit position and initiating the excitation at the next following digit position. The blanking interval $T_b$ is controlled by the delay multivibrator 36 of FIG. 1. The blanking interval $T_b$ of FIG. 2 is effected by the lead from the multivibrator 36 to the decoder 34. Blanking may also be performed with regard to the cathodes and in this instance would be controlled by the lead from the multivibrator 36 to the decoder driver 24. A combination of anode and cathode blanking as illustrated in FIGS. 1 and 2 may also be utilized.

In accordance with the present invention the use of the specifically constituted gas mixture discussed above in the tube 10 permits a blanking interval for streamer elimination that is significantly reduced compared to that required utilizing conventional gaseous atmospheres, such as neon, in the tube 10. Greater than a three fold reduction in the required blanking interval has been achieved utilizing the specified mixture compared to the conventional neon gaseous atmosphere in similarly constructed tubes operating under similar conditions. Specifically a blanking interval of 150 microseconds had been utilized in typical prior art arrangements for streamer elimination which under similar conditions would be reduced to approximately 50 microseconds using the invention.

This significant reduction in required blanking interval for streamer elimination permits a higher refresh rate, hence reducing flicker than has heretofore been achievable with the typical prior art displays without interdigit mechanical isolation. Similarly the present invention permits more digit positions to be multiplexed without attendant flicker than was possible using the prior art arrangements.

Further in accordance with the invention, the blanking interval may be entirely eliminated in a multiplexed tube with the above prescribed gaseous atmosphere and without interdigit mechanical isolation by suitably limiting the current density through the cathodes as well as the applied voltage. Conventional means may be utilized within the decoder driver 24 for so limiting the current density and within the power supply 32 for so limiting the applied voltage. For example, display tubes with approximately 3/10 inch high digits with the above prescribed gaseous atmosphere operated without streamers and without a blanking interval with a current density of 150 milliamperes per square inch of cathode area, and 170 volts maximum applied voltage. For similar displays with approximately ½ inch high digits, 100 milliamperes per square inch of cathode surface and less than 180 volts was utilized to eliminate a requirement for blanking and yet not incur undesirable streamers. It is believed that the display tubes with approximately 3/10 inch high digits will exhibit this effect in the current density range of approximately from 90 to 150 milliamperes per square inch of cathode area and an applied voltage in the range of approximately from 140 volts to 170 volts. It is furthermore believed that the display tubes with the ½ inch high digits will exhibit this effect with a current density in the range of approximately from 45 to 100 milliamperes per square inch of cathode area and an applied voltage in the range of approximately from 140 volts to 180 volts.

With the elimination of a requirement for blanking by utilizing the above prescribed gaseous atmosphere and limited current density and voltage, it is appreciated that the delay multivibrator 36 of FIG. 1 may be dispensed with thus effecting a desirable economy.

The above described improvements in the prior art were achieved by utilizing the above prescribed gaseous atmosphere comprising 99.5 percent neon and 0.5 percent argon in a multiplexed multi-digit display tube without interdigit mechanical isolation. Similar results are obtained where the argon comprises approximately from 0.1 percent to 0.8 percent of the gas mixture. Operation with such gaseous atmospheres at a pressure of 60–65 torr has provided display tubes that very successfully exhibited the above described improvements. It is believed that the above described effect of significantly reduced blanking intervals occurs because of the faster deionization time (to sufficiently low ionization levels) of the prescribed mixture compared to prior art gaseous atmospheres such as neon. The range for the argon constituent of approximately from 0.1 percent to 0.8 percent of the mixture is chosen because it was found that larger amounts of argon in the mixture resulted in high firing and sustaining potentials as well as in low display brightness. In fact, the optimum mixture with 0.5 percent argon was found to provide a minimum in the firing and sustaining potentials compared to pure neon and that the brightness and life of the display decreased fairly rapidly as the percentage of argon was increased.

The above described tubes with which the effects discussed were achieved are of the type described in said U.S. Pat. No. 3,675,066 as well as in U.S. Pat. application No. 742,662 filed July 5, 1968, "Planar Raised Cathode Alphanumeric Gas Discharge Indicator" by Armstrong et. al., assigned to the assignee of the present invention and now abandoned and in U.S. Pat. application No. 158,536, filed June 30, 1971, "Planar Raised Alphanumeric Gas Discharge Indicator" by Armstrong et al., and assigned to the assignee of the present invention.

Figure 3:
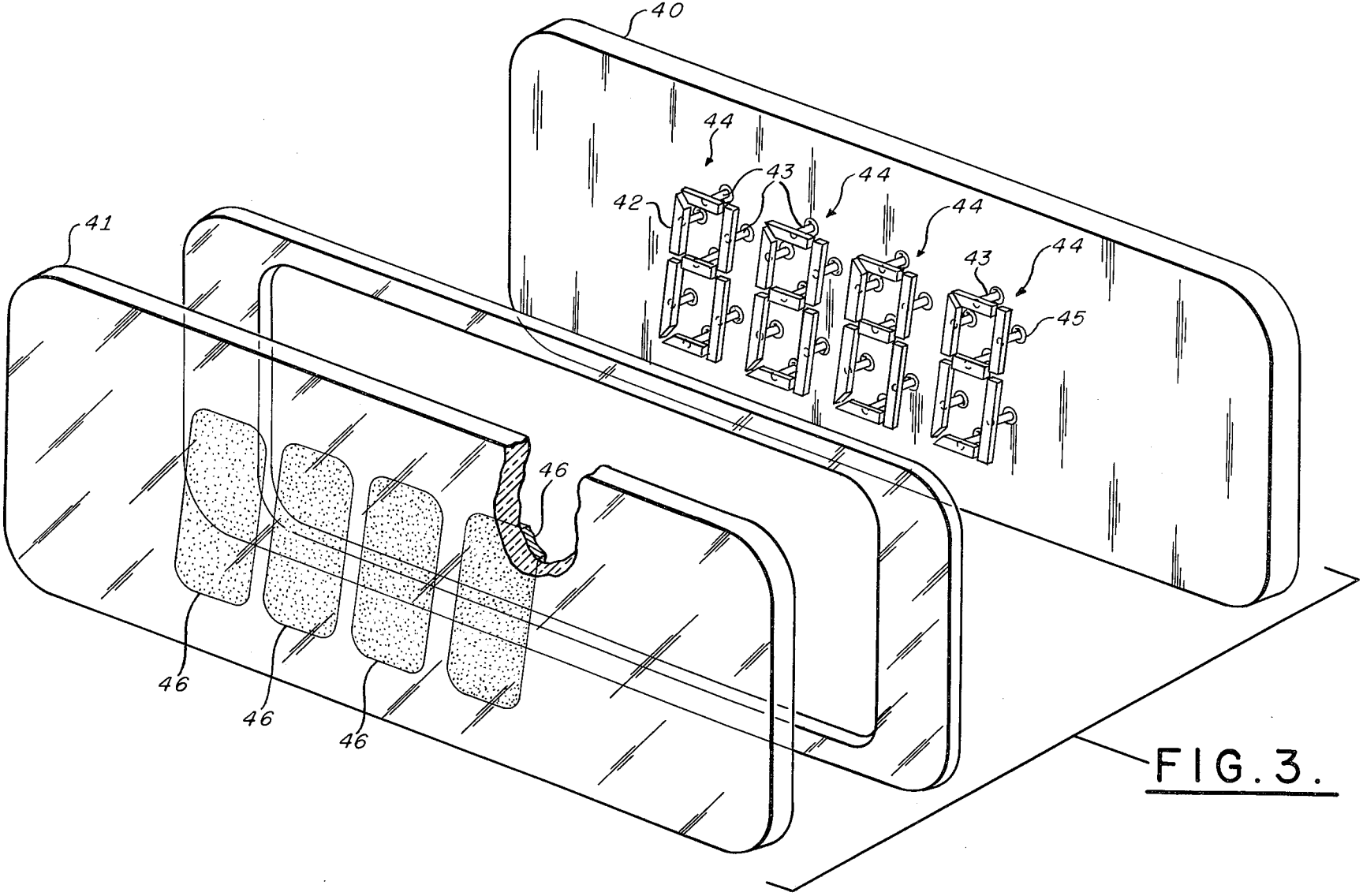

Referring to FIG. 3, such tubes are of planar construction and comprise a closed hermetically sealed envelope having a flat non-conductive back base substrate 40 and a front viewing window 41 hermetically sealed to the substrate around the edges and containing the above prescribed gas mixture. Cathode segments 42 are mounted on cathode support feedthrough pins 43 passing through and hermetically sealed in the substrate 40 whereby the segments lie in a common plane within the envelope with each segment raised above the substrate on the order of 0.005 inches. The cathode segments are arranged in groups 44 generally in the well known figure-eight configuration. The support pins have portions exterior of the envelope for connecting corresponding cathodes in each group to each other to enable electrical potentials to be applied simultaneously thereto in multiplexed fashion. Around the base of each cathode support pin is a cup shaped depression or moat 45 formed on a substrate on the surface thereof facing the cathodes to reduce the effect of sputtering. The envelope is relatively thin and flat and the tube dimensions and operating parameters are such that glow occurs only on the sides of the cathodes facing the viewing window. Anodes 46 are also included within the envelope and are, for example, in a plane in front of and parallel to the plane of the cathodes and spaced from the cathodes on the order of 0.030 inches. The anodes may be of the transparent thin film variety through which the glowing cathodes may be viewed. Other well known anode arrangements may also be utilized. The thin and flat envelope of the tube has a relatively large internal wall area compared to the relatively small internal volume thereof.

The tubes as mentioned above with the approximately 3/10 inch high digits have character heights, character widths, character center to center spacing, cathode segment area and interanode spacing of 0.330 inches, 0.162 inches, 0.375 inches, approximately 0.001 inches squared and approximately 0.070 inches respectively. The tubes as mentioned above with approximately ½ inch high digits have these dimensions as 0.55 inches, 0.271 inches, 0.531 inches, approximately 0.004 inches squared and approximately 0.25 inches respectively.

Tubes of the type described above have exhibited the desirable effect of reduction or elimination of blanking requirements by utilizing the above specified gas mixture. It is believed that the specific tube arrangements as described may contribute to the effect.

It will be appreciated that the circuit of FIG. 1 represents a particular multiplexing arrangement to which the present invention may be applied to obtain the improvements described. Other known multiplexing configurations may also be utilized to the same advantageous effect.

The present invention permits using gas tubes for applications requiring fast timing where under past practice the prior art blanking requirements may have precluded the use of such tubes. This situation may occur particularly in cases where the digit ontime approaches the required blanking time.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A multiple character multianode, raised planar cathode gaseous glow discharge display device adapted for multiplexed operation comprising a closed hermetically sealed planar envelope having a substantially flat non-conductive back base substrate and a front viewing window and containing a prescribed ionizable gas mixture, a plurality of electrically conductive cathode support pins passing in hermetically sealed relation through said substrate into the interior of said sealed envelope to terminate in a common plane parallel to and closely spaced from the interior surface of said substrate, the interior surface of said substrate having a plurality of cup shaped depressions formed therein, each said cup shaped depression surrounding a respective cathode support pin, a plurality of groups of flat strip-like raised planar cathodes, each group arranged in a character forming pattern and each cathode supported at the central region thereof on a respective pin end interior of said envelope so that the bottom flat surfaces of the cathodes lie in said common plane spaced from the interior surface of said substrate whereby glow is substantially eliminated from the bottom surfaces of said cathodes in operation of said device, said pins having portions exterior of said envelope for connecting corresponding cathodes in each said group to each other to enable electrical potential to be applied simultaneously thereto in multiplexed fashion, and plural, adjacent anode means disposed within said envelope in spaced relation to said cathodes; one anode means for each cathode group;

said prescribed ionizable gas mixture comprising neon and argon with said argon constituting approximately from 0.1 percent to 0.8 percent of said mixture, said device cathodes being disposed at heights of from at least one to a few mils and operated at minimum current density and maximum anode-cathode voltage conditions on the order respectively of about one-tenth ampere per square inch and at about one hundred to two hundred volts;

whereby in operation of said device the blanking interval utilized for streamer elimination is reduced to an arbitrarily small value in accordance with the anode-to-cathode voltage applied to said device and the current density through said cathodes as well as in accordance with electrode geometry and spacing.

2. The device of claim 1 in which said prescribed gas mixture comprises 99.5 percent neon and 0.5 percent argon.

3. The device of claim 1 in which said envelope is relatively thin and flat and has a relatively large internal wall area compared to the internal volume thereof.

4. The device of claim 1 in which said common plane is spaced on the order of 0.005 inches from said interior surface of said substrate.

5. The device of claim 4 in which said anode means is spaced on the order of 0.03 inches from said cathodes.

6. The device of claim 1 in which said groups of cathodes define characters of height, width and center-to-center spacing on the order of 0.33 inches, 0.162 inches and 0.375 inches respectively.

7. The device of claim 6 in which the area of each said cathode is on the order of 0.001 inches squared and the inter-anode spacing between said anode means is on the order of 0.0070 inches.

8. The device of claim 1 in which said groups of cathodes define characters of height, width and center-to-center spacing on the order of 0.55 inches, 0.271 inches and 0.531 inches respectively.

9. The device of claim 8 in which the area of each said cathode is on the order of 0.004 inches squared and the inter-anode spacing between said anode means is on the order of 0.25 inches.

10. A multiplexed multiple character multi-anode, raised planar cathode gaseous glow discharge display device comprising a plurality of groups of raised planar cathodes, each group arranged in a character forming pattern, connection means for electrically connecting corresponding cathodes in each group to each other to enable electrical potentials to be applied simultaneously to selected corresponding electrodes in each group, a plurality of operatively adjacent anodes operatively associated with said groups of cathodes respectively, means for individually energizing said anodes in a predetermined order, envelope means enclosing said cathodes and anodes, and a prescribed mixture within said envelope means comprising neon and argon with said argon constituting approximately from 0.1 percent to 0.8 percent of said mixture, said device cathodes being disposed at heights of from at least one to a few mils and operated at minimum current density and maximum anode-cathode voltage conditions on the order respectively of about one-tenth ampere per square inch and at about 100 to 200 volts;

whereby in operation of said device the blanking interval utilized for streamer elimination is reduced to an arbitrarily small value in accordance with the voltage applied to said anodes and the current density through said cathodes as well as in accordance with electrode geometry and spacing.

11. The device of claim 10 in which said prescribed mixture comprises 99.5 percent neon and 0.5 percent argon.

12. The device of claim 10 further including blanking means for providing said blanking interval for eliminating streamers, said interval being substantially smaller than that required for streamer elimination with gaseous atmospheres other than said prescribed mixture.

* * * * *